US010750264B2

(12) United States Patent
Yuan et al.

(10) Patent No.: US 10,750,264 B2
(45) Date of Patent: Aug. 18, 2020

(54) LOUDSPEAKER AND LOUDSPEAKER SHOCK ABSORPTION STRUCTURE

(71) Applicant: GUANGZHOU SHIRUI ELECTRONICS CO., LTD., Guangzhou, Guangdong (CN)

(72) Inventors: Jiabin Yuan, Guangzhou (CN); Zongtao Zhang, Guangzhou (CN); Yulong Wang, Guangzhou (CN)

(73) Assignee: GUANGZHOU SHIRUI ELECTRONICS CO., LTD., Guangzhou, Guangdong (CN)

( * ) Notice: Subject to any disclaimer, the term of this patent is extended or adjusted under 35 U.S.C. 154(b) by 79 days.

(21) Appl. No.: 16/490,537

(22) PCT Filed: Dec. 30, 2016

(86) PCT No.: PCT/CN2016/113753
§ 371 (c)(1),
(2) Date: Aug. 31, 2019

(87) PCT Pub. No.: WO2017/157085
PCT Pub. Date: Sep. 21, 2017

(65) Prior Publication Data

US 2020/0077167 A1 Mar. 5, 2020

(30) Foreign Application Priority Data

Mar. 17, 2016 (CN) ..... 2016 2 0208350 U

(51) Int. Cl.
*H04R 1/02* (2006.01)

(52) U.S. Cl.
CPC ..... *H04R 1/026* (2013.01)

(58) Field of Classification Search
CPC ..... H04R 1/026; H04R 1/2803; H04R 1/025
See application file for complete search history.

(56) References Cited

U.S. PATENT DOCUMENTS 6,744,903 B1 * 6/2004 Jeon ..... G06F 1/1605 348/E5.13
7,995,786 B2 * 8/2011 Yu ..... H04R 1/025 381/333

FOREIGN PATENT DOCUMENTS

CN 1271244 A 10/2000
CN 1072436 C 10/2001
(Continued)

OTHER PUBLICATIONS

International Application No. PCT/CN2016/113753, International Search Report dated Mar. 8, 2017, 5 pages.

*Primary Examiner* — Brian Ensey
(74) *Attorney, Agent, or Firm* — Zhong Law, LLC

(57) ABSTRACT

The present utility model relates to a loudspeaker, in particular to a loudspeaker and a loudspeaker shock absorption structure, which comprise a first elastomer for connecting with a loudspeaker body and a second elastomer for connecting with a loudspeaker fastener structure, the first elastomer and the second elastomer are connected by a cantilever, the cantilever is made of an elastic material. The present utility model forms a non-coaxial connection structure between the loudspeaker body and the loudspeaker fastener structure by setting a cantilever, so that a force produced by a vibration of the loudspeaker body cannot be directly transmitted to the loudspeaker fastener structure. Instead, the force is acted on the fastener structure in the form of a small force after being weakened by buffering and filtering via the cantilever, thereby greatly reducing a machine vibration caused by a large amplitude of the loudspeaker.

17 Claims, 4 Drawing Sheets

(56) References Cited

FOREIGN PATENT DOCUMENTS

| | | | |
|---|---|---|---|
| CN | 2671273 | Y | 1/2005 |
| CN | 101111090 | A | 1/2008 |
| CN | 101237545 | A | 8/2008 |
| CN | 201491161 | U | 5/2010 |
| CN | 201657174 | U | 11/2010 |
| CN | 202026461 | U | 11/2011 |
| CN | 202261707 | U | 5/2012 |
| CN | 202353767 | U | 7/2012 |
| CN | 202424893 | U | 9/2012 |
| CN | 203522989 | U | 4/2014 |
| CN | 205490993 | U | 8/2016 |
| EP | 1185094 | A2 | 3/2002 |
| JP | 201130212 | A | 2/2011 |
| KR | 20000004269 | A | 1/2000 |
| KR | 20090079527 | A | 7/2009 |
| WO | 2013097084 | A1 | 7/2013 |

* cited by examiner

LOUDSPEAKER AND LOUDSPEAKER SHOCK ABSORPTION STRUCTURE

CROSS-REFERENCE TO RELATED APPLICATIONS

This application is a national stage of PCT/CN2016/113753 filed Dec. 30, 2016, which claims priority to Chinese application CN 201620208350.1 filed Mar. 17, 2016, the contents of which are hereby incorporated by reference in their entireties.

TECHNICAL FIELD

The present utility model relates to a loudspeaker, and in particular, to a loudspeaker and a loudspeaker shock absorption structure.

BACKGROUND

Current approaches to absorb the shock of a loudspeaker are to directly use an elastic structure to separate the loudspeaker from a fastener to achieve the reduction of shock; as shown in FIG. 1 and FIG. 2, in a conventional loudspeaker shock absorption structure, only one layer of rubber washer 1 is arranged between a loudspeaker body and a loudspeaker fastener structure. In a low frequency band, the vibration of the loudspeaker body 2 has a large amplitude, which can easily cause vibration of the rubber washer, producing a force F1 that is directly transmitted to the loudspeaker fastener structure 3 and thereby causing a machine vibration for loose parts inside a machine, especially for a heavy bass loudspeaker which has a high probability of the machine vibration.

At present, the problem of machine vibration of the loudspeaker has been a problematic area for major TV manufacturers with no suitable solutions.

SUMMARY

An objective of the utility model is to provide a loudspeaker and a loudspeaker shock absorption structure so as to reduce a machine vibration caused by a large-amplitude vibration of the loudspeaker.

In order to achieve the above objective, the present utility model provides a loudspeaker shock absorption structure, which includes a first elastomer for connecting with a loudspeaker body and a second elastomer for connecting with a loudspeaker fastener structure, where the first elastomer and the second elastomer are connected by a cantilever that is made of an elastic material.

As a preferred embodiment, the cantilever has an S-shaped cross section.

As a preferred embodiment, the first elastomer is configured with an annular groove for clamping with the loudspeaker body, and the cantilever is configured with a first opening communicatively connected to the annular groove.

As a preferred embodiment, the cantilever is further configured with a second opening.

As a preferred embodiment, an outer surface of the second elastomer is configured with at least one convex ring.

As a preferred embodiment, the first elastomer and the second elastomer are both silica gel sealing rings.

As a preferred embodiment, the second elastomer is configured with a through hole for connecting with the loudspeaker fastener structure.

In order to achieve the same objective, the present utility model further provides a loudspeaker, which includes a loudspeaker body, a loudspeaker fastener structure and the loudspeaker shock absorption structure described above, where the loudspeaker body is connected with the first elastomer, and the loudspeaker fastener structure is connected with the second elastomer.

As a preferred embodiment, the first elastomer is configured with an annular groove for clamping with the loudspeaker body, and the cantilever is configured with an opening communicatively connected to the annular groove; the loudspeaker body is configured with a snap ring matched with the annular groove;

the snap ring is clamped with the annular groove through the opening;

the second elastomer is configured with a through hole for connecting with the loudspeaker fastener structure; the loudspeaker fastener structure is configured with a connecting post matched with the through hole; and the connecting post passes through the through hole and is tightened through a fastener.

As a preferred embodiment, there is a gap between the fastener and the second elastomer along an axial direction of the connecting post.

The utility model provides a loudspeaker and a shock absorption structure thereof, the first elastomer and the second elastomer are connected by the cantilever, and the cantilever is made of an elastic material. The present embodiment forms a non-coaxial connection structure between the loudspeaker body and the loudspeaker fastener structure by setting the cantilever, so that a force produced by a vibration of the loudspeaker body cannot be directly transmitted to the loudspeaker fastener structure. Instead, the force is acted on the fastener structure in the form of a small force after being weakened by buffering and filtering via the cantilever, thereby greatly reducing the machine vibration caused by a large vibration amplitude of the loudspeaker.

BRIEF DESCRIPTION OF DRAWING(S)

Among them, 1. Rubber washer; 2. Loudspeaker body; 3. Loudspeaker fastener structure; 10. First elastomer; 11. Annular groove; 20. Second elastomer; 21. Through hole; 22. Convex ring; 30. Cantilever; 31. First opening; 32. Second opening; 40. Loudspeaker body; 50. Loudspeaker fastener structure; 51. Connecting post; 60. Fastener.

DESCRIPTION OF EMBODIMENTS

The specific implementations of the present utility model are further described in detail below with reference to the accompanying drawings and embodiments. The following embodiments are intended to illustrate the present utility model, but are not intended to limit the scope of the present utility model.

Figure 1:
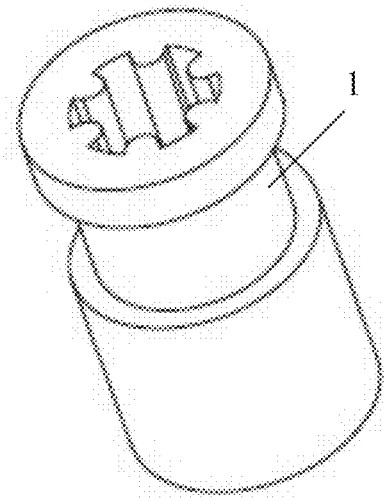
(PRIOR ART) FIG. 1
FIG. 1 is a perspective view of a rubber washer described in the background.
Figure 2:
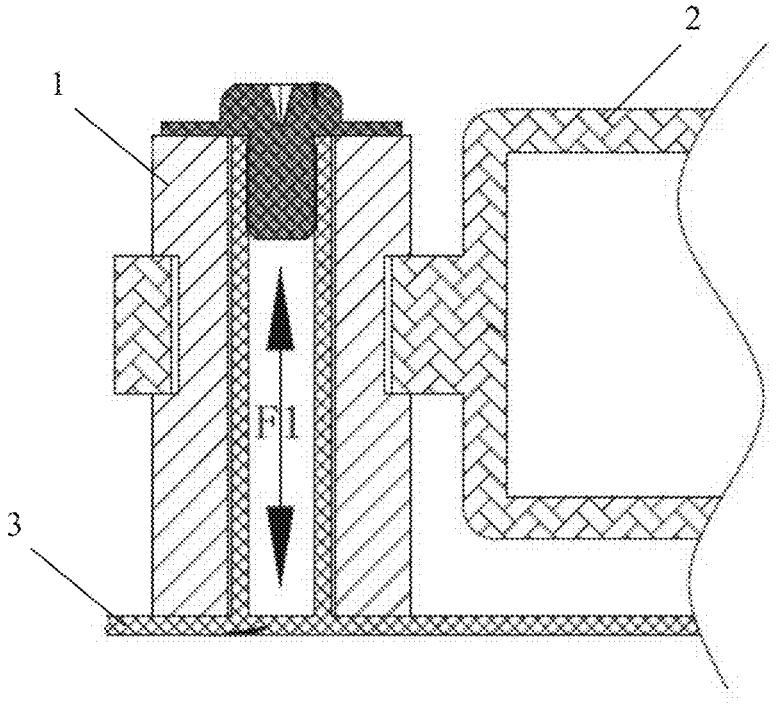
(PRIOR ART) FIG. 2
FIG. 2 is a partial cross-sectional view of a loudspeaker described in the background.
Figure 3:
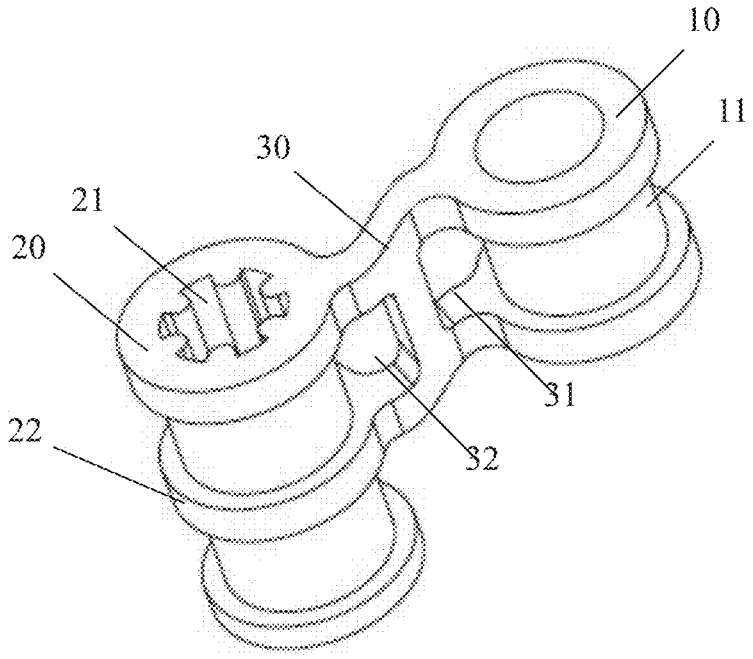
FIG. 3 is a perspective view of a loudspeaker shock absorption structure of the present utility model.

As shown in FIG. 3, a loudspeaker shock absorption structure of a preferred embodiment of the present utility model includes a first elastomer 10 for connecting with a loudspeaker body and a second elastomer 20 for connecting with a loudspeaker fastener structure, where the elastomer 10 and the elastomer 20 are connected by a cantilever 30, and the cantilever 30 is made of an elastic material. In the present embodiment, a non-coaxial connection structure is formed between the loudspeaker body and the loudspeaker fastener structure by setting the cantilever 30, so that a force F1 produced by a vibration of the loudspeaker body cannot be directly transmitted to the loudspeaker fastener structure. Instead, acted on the fastener structure in the form of a small force F2 after being weakened by buffering and filtering via the cantilever 30, thereby greatly reducing the machine vibration caused by a large amplitude of the loudspeaker.

Preferably, the first elastomer 10 and the second elastomer 20 of the embodiment are both silica gel sealing rings.

The cantilever 30 has a S-shaped cross section, and the S-shaped cantilever 30 can further reduce the transmission of a lateral vibration of the loudspeaker.

The second elastomer 20 is configured with a through hole 21 for connection with the loudspeaker fastener structure, and the through hole 21 has a polygonal cross section, thereby to ensure a firm connection between the first elastomer 10 and the loudspeaker fastener structure. In addition, the first elastomer 10 is configured with an annular groove 11 for clamping with the loudspeaker body 40, the cantilever 30 is configured with a first opening 31 communicatively connected to the annular groove 11, and the first opening 31 is configured to facilitate the first elastomer 10 to be clamped with the loudspeaker body 40. Preferably, the cantilever 30 is further configured with a second opening 32, a spacer post is configured between the second opening 32 and the first opening 31, the second opening 32 is adjacent to a side of the second elastomer 20, and the rigidity of the cantilever 30 can be changed by a proper design of a gap L1 of the second opening 32, thereby achieving matching with loudspeakers with different sizes and powers. For example, for a loudspeaker with a heavier weight or a higher power, the gap L1 of the second opening 32 can be correspondingly increased; on the contrary, for a loudspeaker with a lighter weight or a lower power, the gap L1 of the second opening 32 can be correspondingly reduced.

In order to improve the buffering effect of the second elastomer 20, an outer surface of the second elastomer 20 is configured with at least one convex ring 22, and the second elastomer 20 configured with the convex ring 22 can further reduce the vibration conduction in the longitudinal direction of the loudspeaker, compared to an elastomer with a smooth outer surface without the convex ring 22. Preferably, there is a plurality of convex rings 22, and the plurality of convex rings 22 are sequentially disposed along the axial direction of the second elastomer 20.

Figure 4:
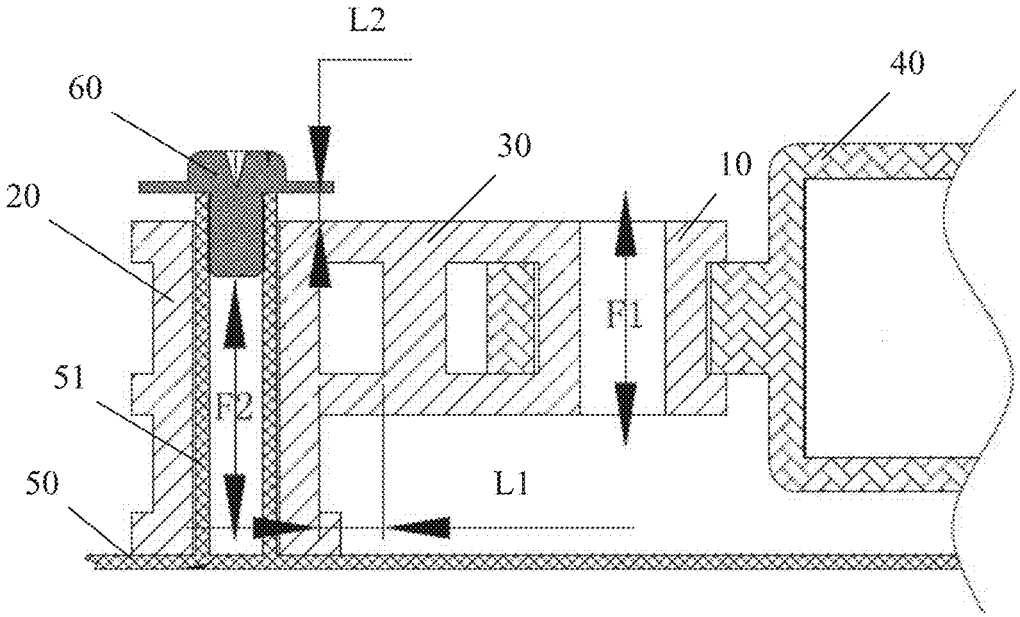
FIG. 4 is a partial cross-sectional view of a loudspeaker of the present invention.

As shown in FIG. 4, the present utility model further provides a loudspeaker, which including a loudspeaker body 40, a loudspeaker fastener structure 50 and the loudspeaker shock absorption structure described above, where the loudspeaker body 40 is connected with a first elastomer 10, the loudspeaker fastener structure 50 is connected with a second elastomer 20, and the first elastomer 10 and the second elastomer 20 are connected by a cantilever 30. Specifically, the first elastomer is configured with an annular groove 11 for clamping with the loudspeaker body 40, the cantilever 30 is configured with an opening communicatively connected to the annular groove 11; the loudspeaker body 40 is configured with a snap ring matched with the annular groove 11; and the snap ring is clamped with the annular groove 11 through the opening. The second elastomer 20 is configured with a through hole 21 for connecting with the loudspeaker fastener structure 50; the loudspeaker fastener structure 50 is configured with a connecting post 51 matched with the through hole 21; one end of the connecting post 51 is connected with the loudspeaker fastener structure 50, and the other end of the connecting post 51 passes through the through hole 21 and is tightened through a fastener 60.

The connecting post 51 has a length greater than that of the through hole 21 of the second elastomer 20, so that one end of the connecting post 51 protrudes from the through hole 21 of the second elastomer 20, and thus there is a gap L2 between the fastener 60 and the second elastomer 20 along the axial direction of the connecting post 51, the gap L2 makes that there is a certain buffering distance between the second elastomer and the fastener 60, reducing the rigidity at the junction of the second elastomer 20 and the fastener 60, and further weakening the force of the force F2 exerted on the loudspeaker fastener structure.

In summary, the loudspeaker and the shock absorbing structure thereof provided in the present utility model have the following advantages:

1. Forming a non-coaxial connection structure between the loudspeaker body 40 and the loudspeaker fastener structure by setting the cantilever 30, so that the force F1 produced by a vibration of the loudspeaker body 40 cannot be directly transmitted to the loudspeaker fastener structure. Instead, the force is acted on the fastener structure in the form of a small force F2 after being weakened by buffering and filtering via the cantilever 30;

2. The cantilever 30 has a S-shaped cross section, and the S-shaped cantilever 30 can further reduce the transmission of a lateral vibration of the loudspeaker;

3. The first elastomer is further configured with the second opening 32, the rigidity of the cantilever 30 can be changed by a proper design of the gap L1 of the second opening 32, thereby achieving matching with loudspeakers with different sizes and powers;

4. There is the gap L2 between the fastener 60 and the second elastomer 20 along the longitudinal direction, which can further weaken a force of the force F2 on the loudspeaker fastener structure.

The above description is only a preferred embodiment of the present utility model, and it should be noted that those skilled in the art can make improvements and substitutions without departing from the technical principle of the present utility model, and these improvements and substitutions should also be considered within the protection scope of the present utility model.

What is claimed is:

1. A loudspeaker shock absorption structure, comprising a first elastomer for connecting with a loudspeaker body and a second elastomer for connecting with a loudspeaker fastener structure, wherein the first elastomer and the second elastomer are connected by a cantilever, and the cantilever is made of an elastic material, and wherein the first elastomer is configured with an annular groove for clamping with the loudspeaker body, and the cantilever is configured with a first opening communicatively connected to the annular groove.

2. The loudspeaker shock absorption structure according to claim 1, wherein the cantilever comprises a S-shaped cross section.

3. A loudspeaker shock absorption structure, comprising a first elastomer for connecting with a loudspeaker body and a second elastomer for connecting with a loudspeaker fastener structure, wherein the first elastomer and the second elastomer are connected by a cantilever, and the cantilever is made of an elastic material, and wherein the cantilever is further configured with a second opening.

4. A loudspeaker shock absorption structure, comprising a first elastomer for connecting with a loudspeaker body and a second elastomer for connecting with a loudspeaker fastener structure, wherein the first elastomer and the second elastomer are connected by a cantilever, and the cantilever is made of an elastic material, and wherein an outer surface of the second elastomer is configured with at least one convex ring.

5. The loudspeaker shock absorption structure according to claim 1, wherein the first elastomer and the second elastomer are both silica gel sealing rings.

6. The loudspeaker shock absorption structure according to claim 1, wherein the second elastomer is configured with a through hole for connecting with the loudspeaker fastener structure.

7. A loudspeaker, comprising a loudspeaker body, a loudspeaker fastener structure, and the loudspeaker shock absorption structure according to claim 1, wherein the loudspeaker body is connected with the first elastomer, the loudspeaker fastener structure is connected with the second elastomer.

8. The loudspeaker according to claim 7, wherein the first elastomer is configured with an annular groove for clamping with the loudspeaker body, the cantilever is configured with an opening communicatively connected to the annular groove, and the loudspeaker body is configured with a snap ring matched with the annular groove;

the snap ring is clamped with the annular groove through the opening;

the second elastomer is configured with a through hole for connecting with the loudspeaker fastener structure, the loudspeaker fastener structure is configured with a connecting post matched with the through hole, and the connecting post passes through the through hole and is tightened through a fastener.

9. The loudspeaker according to claim 8, wherein a gap is provided between the fastener and the second elastomer along an axial direction of the connecting post.

10. The loudspeaker shock absorption structure according to claim 3, wherein the cantilever comprises a S-shaped cross section.

11. The loudspeaker shock absorption structure according to claim 3, wherein an outer surface of the second elastomer is configured with at least one convex ring.

12. The loudspeaker shock absorption structure according to claim 3, wherein the first elastomer and the second elastomer are both silica gel sealing rings.

13. The loudspeaker shock absorption structure according to claim 3, wherein the second elastomer is configured with a through hole for connecting with the loudspeaker fastener structure.

14. The loudspeaker shock absorption structure according to claim 4, wherein the cantilever comprises a S-shaped cross section.

15. The loudspeaker shock absorption structure according to claim 4, wherein the cantilever is further configured with a second opening.

16. The loudspeaker shock absorption structure according to claim 4, wherein the first elastomer and the second elastomer are both silica gel sealing rings.

17. The loudspeaker shock absorption structure according to claim 4, wherein the second elastomer is configured with a through hole for connecting with the loudspeaker fastener structure.

* * * * *